US005501912A

United States Patent [19]

Sergenius

[11] Patent Number: 5,501,912

[45] Date of Patent: Mar. 26, 1996

[54] STRIP MATERIAL

[76] Inventor: Jan G. Sergenius, Bergsundsgatan 15, S-117 37 Stockholm, Sweden

[21] Appl. No.: 204,315

[22] PCT Filed: Sep. 18, 1992

[86] PCT No.: PCT/SE92/00640

§ 371 Date: Mar. 14, 1994

§ 102(e) Date: Mar. 14, 1994

[87] PCT Pub. No.: WO93/05901

PCT Pub. Date: Apr. 1, 1993

[30] Foreign Application Priority Data

Sep. 20, 1991 [SE] Sweden ..... 9102729

[51] Int. Cl.[6] ..... B21D 13/10; E04C 2/32; B32B 3/28

[52] U.S. Cl. ..... 428/604; 428/603

[58] Field of Search ..... 428/603, 604, 428/182, 183, 184, 185

[56] References Cited

U.S. PATENT DOCUMENTS

| | | | |
|---|---|---|---|
| 235,449 | 12/1880 | Newton | 428/183 |
| 1,240,231 | 9/1917 | Lumley | 428/182 |
| 1,704,326 | 3/1929 | Junkers | 428/603 |
| 1,868,302 | 7/1932 | Auger | 428/603 |
| 1,993,172 | 3/1935 | Kent | 156/210 |
| 2,233,592 | 3/1941 | Dunajeff | 428/604 |
| 2,896,692 | 7/1959 | Villoresi | 264/287 |
| 3,165,815 | 1/1965 | Wogerbauer | 428/604 |
| 3,254,968 | 6/1966 | Bender | 428/603 |
| 4,518,544 | 5/1985 | Carter et al. | 428/183 |
| 5,314,738 | 5/1994 | Ichikawa | 428/182 |

FOREIGN PATENT DOCUMENTS

| | | | |
|---|---|---|---|
| 820849 | 11/1951 | Germany | 428/182 |
| 2211925 | 9/1973 | Germany . | |
| 2806680 | 8/1978 | Germany . | |
| 219724A1 | 3/1985 | Germany | 428/182 |
| 64-8031 | 1/1989 | Japan | 428/182 |

*Primary Examiner*—John Zimmerman

*Attorney, Agent, or Firm*—Griffin, Butler, Whisenhunt & Kurtossy

[57] ABSTRACT

The invention relates to a material in the form of a strip having a stiffening corrugation thereon. The corrugation consists of ridges and valleys therebetween which form arcs over the breadth of the corrugation zone. The corrugations form a wave pattern propagating in the longitudinal direction of the strip. The waves have no straight sections, and the relationship between the thickness of the strip T and the corrugation depth A is 0.5T<A<2T. In addition, the height of the arcs is at least as large as the wave length of the waves propagating in the Y-direction and alternating in the Z-direction.

13 Claims, 8 Drawing Sheets

13
21
13
2a'
3a'
3b'
8'
3c'
2b'
8'
2c'

IV
III
II
7a
6a
3a
2a
3b
7b
9
2b
7c
3c
10
9
8
2c
1
6b
8
6c
IV
III
II
Z
Y
X

STRIP MATERIAL

TECHNICAL FIELD

The invention relates to a material in the form of a strip, plate, foil, sheet, board or corresponding, provided with a corrugation or embossing which increases the stiffness of the material but at the same time makes it possible to bend the material to a high degree without exceeding it's yield point, i.e. without causing permanent deformation, which corrugation or embossing has the shape of ridges and valleys therebetween, the isohypsis of said ridges and valleys, within the region of a conceived strip shaped zone of the material, forming arcs when projected on an X-Y-plane in a three dimensional coordinate system, in which the X-direction coincides with the longitudinal direction of the corrugated zone, the Y-direction coincides with the breadth direction of the corrugated-zone, and the Z-direction is perpendicular to the X-Y-plane, while sections in the Y-Z-plane form a wave pattern consisting of waves alternating in the Z-direction.

BACKGROUND ART

Corrugation or embossing is a conventional means of increasing the stiffness and the resistance against bending of comparatively thin materials in at least one direction. The technique is used in a variety of applications. For example may be mentioned corrugated sheet iron. Corrugated board is another example, as according to DE-A1-2 211 925. Also in nature there are many shapes where folding patterns and the like give increased stiffness. It is in these examples often the question of comparatively thin materials, i.e. blades on flowers and grass, etc.

BRIEF DESCRIPTION OF THE INVENTION

It is an object of the invention to provide a new corrugation pattern which can be applied on the kinds of material mentioned in the preamble in order to increase the resistance to bending of the materials but at the same time make it possible to bend the material to a substantial degree without increasing the yield point of the material, i.e. without causing permanent deformation.

These and other objectives can be achieved therein that the height of the arcs projected on the X-Y-plane, arc height being defined as the extension of the arcs in the Y-direction within said zone, is at least as large as or larger then the wave length of said waves alternating in the Z-direction.

The corrugation or the embossing within the region of the conceived, strip shaped zone of the material thus consists of ridges and valleys alternatingly, said ridges and valleys extending in the shape of arcs over the breadth of the zone. These arcs preferably consist of parabolas but they can also have other shapes, e.g. be circular arcs, hyperbolas, or other preferably symmetrical curves.

Disregarding the method of defining the corrugation pattern, the distance in the longitudinal direction of the strip shaped zone, for each of said ridges, between on one hand the points of intersection between the crest line curve and the zone edges, and on the other hand the point of intersection between the crest line curve and a plane in the longitudinal direction of the zone, perpendicular to the zero plane or basic plane of the material and the tip point of the intersecting arc, is at least as large as or larger than the distance between said tip point and the tip point on an adjacent ridge.

The material can exhibit a single zone of the above mentioned type or several such zones, which are arranged parallel to each other, and each of which exhibits the said arc shaped corrugation pattern, and these arcs may be arranged in the same or in opposite directions, as is indicated in the appending claims. Preferably the ridges and valleys flat out in those edges of the material which are parallel with the longitudinal direction of the zone or the zones.

Preferably the above described corrugation is superimposed on a basic shape of the material, in which the basic shape is arcuated in a plane perpendicular to the longitudinal direction of said zone or zones. More particularly the basic shape of the material in said plane preferably forms an arc within each corrugated zone, i.e. the material is arcuated within the zone, and the described corrugation has been superimposed on this arcuated shape, so that the corrugation itself has been afforded an arcuated shape perpendicular to the longitudinal direction. If the material has more than one corrugated zone, which it normally has according to the invention, the material can be arcuated in different directions. If the number of zones is two, the basic shape of the material thus will have an S-shape in cross section.

Further features and aspects of the invention and of the corrugation pattern will be apparent from the appending claims and from the following description of various embodiments.

Typically, the material of the invention consists of a thin, cold rolled, hardened and tempered steel strip. This material, which exhibits the embossing pattern characteristic for the invention can be used e.g. for

- measure tapes,
- so called strip antennas for in the first place portable radio and TV receivers,
- springs, particularly for rolling up springs for e.g. wind-up drums for flexible cables for vacuum cleaners and other electrical apparatuses, for winding up starting straps for combustion engines, for winding up safety belts in motor cars, etc.,
- spring elements in shock absorbers, power equalizers, etc., in which cases the material may be comparatively broader.

The principals of the invention also can be used for other elastic materials than metallic materials, e.g. for paper, paper board and plastic, as well as for composite materials containing one or more of said materials. Within this area the material of the invention may be used as packaging material. It is also conceivable to combine several layers of the material of the invention and to unite these layers with each other to form a sandwich material having a good bendability but at the same time desired stiffness.

BRIEF DESCRIPTION OF DRAWINGS

The invention will be explained more in detail in the following with reference to some conceivable embodiments and also through the description of performed tests. Herein reference will be made to the accompanying drawings, in which.

Figures 1, 5:
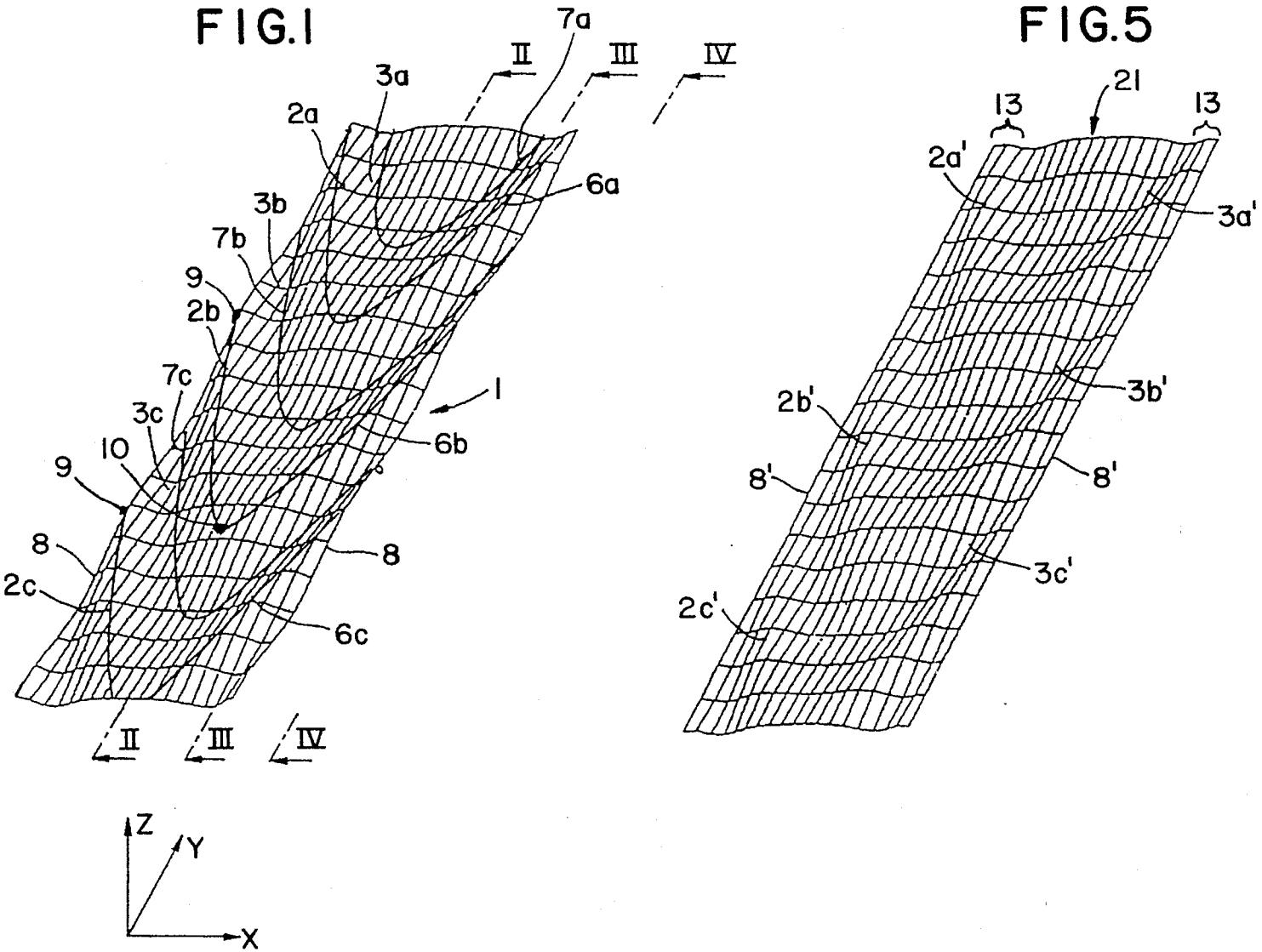
FIG. 1 is a perspective view of a strip of the invention with a corrugated zone extending over the entire breadth of the strip.
FIG. 5 is a perspective view of a strip having the same embossing pattern as the strip in FIG. 1 but with the difference that the ridges and the valleys in the corrugation pattern flat out in the strip edges.

The thicknesses have been strongly exaggerated in the shown sectional views.

DESCRIPTION OF PREFERRED EMBODIMENTS

Embodiment I

This embodiment, which is illustrated in FIGS. 1–4, concerns a strip shaped product, more particularly a comparatively narrow strip shaped product 1. The material preferably consists of a thin, hardened and tempered steel, but also other materials can be used, as has been mentioned above, provided the material is elastically deformable in the choosen dimension.

The material has a flat basic form according to embodiment I as well as according to the following embodiments II–V. The embossing pattern is superimposed on this flat basic form, and has according to the embodiment the shape of identically shaped ridges 2*a*, 2*b*, 2*c* . . . 2*n* which alternate with valleys 3*a*, 3*b*, 3*c* . . . 3*n* and are continously repeated along the length of strip 1. The zero-plane of strip 1 has been designated 4 in FIG. 2. The zero-plane 4 according to the embodiment corresponds to the center plane of the flat starting material and with the X-Y-plane in a conceived three dimensional coordinate system having the X-direction perpendicular to the longitudinal direction of the strip, the Y-direction coinciding with the longitudinal direction of the strip, and the Z-direction perpendicular to the zero-plane. Further, the Y-Z-plane coincides with a longitudinal plane of symmetry of strip 1.

The center line 5 of the strip forms a waved curve in a section coinciding with the said plane of symmetry as in each section parallel with this Y-Z-plane, more particularly a sine-wave curve which symmetrically alternates about the zero-plane 4. The amplitude A of the wave thus corresponds to the embossing depths. The strip thickness has been designated T. The wave length of the sine-wave is designated L.

The lines along the ridge crests, hereinafter referred to as ridge crest curves, are designated 6*a*, 6*b*, 6*c*, etc., while the bottom lines of the valleys are designated 7*a*, 7*b*, 7*c*, etc. The ridge crest curves 6*a*, 6*b*, 6*c*, etc., as well as the bottom lines 7*a*, 7*b*, 7*c*, etc., define contour-lines or so called isohypsis, with a terminology borrowed from topography,. i.e. lines defined by points lying at equal height above or at equal depth beneath a certain zero-plane, in this case zero-plane 4. According to the embodiment the ridge crest curves 6*a*, 6*b*, 6*c*, etc. and the bottom lines 7*a*, 7*b*, 7*c*, etc. as well as all contour-lines on the ridges or on the slopes of the valleys between the ridges and the bottom lines form arcs when projected on the zero-plane, which arcs are symmetrical about the Y-Z-plane (the plane of symmetry). More particularly the said arcs have the shape of parabolas which extend over the entire breadth of the strip, having the nose of the parabola in the symmetry plane.

The strip edges have been designated 8. The points of intersection between the ridge crest curves and the strip edges are designated 9, and the nose points of the ridge crest curves are designated 10. The distance in the Y-direction between one of the first said points 9 and the nose point 10 on the same ridge crest curve, e.g. the ridge crest curve 6*c*, is referred to as the phase difference F of the wave pattern in this context. The termwave pattern in this context is used for the pattern which is generated by the previously mentioned waves in the Y-Z-plane and planes parallel with the Y-Z-plane. According to embodiment I the phase difference F has at least or approximately the same length as the wave length L, i.e. corresponding to about $2\pi$ rad or 360°.

The tension forces in the material can be distributed very evenly in the material due to the described embossing pattern such that the yield point of the material is not exceeded, even if the strip is subjected to extreme bending in the Z-direction. This is due to the fact that there does not exist any tangent in any point of the embossing pattern on the same side of the plane of symmetry having the same inclination or direction as any other tangent. Because of this, if the strip is subjected to bending in the Z-direction, there is caused a shear relative to all adjacent volume elements of the strip, also in the X- and Y-directions. This implies that the shearing resistance in all directions of the entire material volume is utilized, i.e. in the X- as well as in the Y- and-Z-directions, although the bending is performed only in one of the directions; the Z-direction. This implies there is achieved a more even distribution of the tension forces, which are spread out over a larger volume region, and also with a larger total tension or accumulated power as compared with a conventional strip having a conventional C-profile or an S-profile, at the same time as a corresponding bendability is maintained. This means that it is possible to achieve a considerably larger stiffness in combination with an equally good bendability of the strip as for non-embossed flat or C- or S-profiled strips, although the embossing depths A is rather small. Normally the following expression applies: 0.5 T<A<2 T, where T=the thickness of the strip.

Embodiment II

In embodiment I the wave pattern extended with equal amplitude all the way out to the strip edges 8. This has the drawback that tension concentrations may occur in the edge zones when the strip is subjected to a bending moment which may initiate buckling of the strip. The embodiment illustrated in FIG. 5 aims at eliminating this drawback. Therefore ridges 2*a*', 2*b*', etc and valleys 3*a*', 3*b*', etc flat out the two edge zones 13, FIG. 5, therein that the amplitude A, which corresponds to the embossing depth, successively approaches and reaches zero in the edge zones 13. The amplitude of the wave pattern in the strip edges 8' thus is zero according to embodiment II. The edge zones 13 has a breadth corresponding to the distance between section III—III and corresponding strip edge 8'. The rest of strip 21, FIG. 5, is embossed in a mode which is identical to corresponding parts of strip 1 according to embodiment I and may, as a compensation for the diminishing embossing depth in the edge zones be afforded an increase of the phase difference in comparison to the wave length.

Embodiment III

Figure 6:
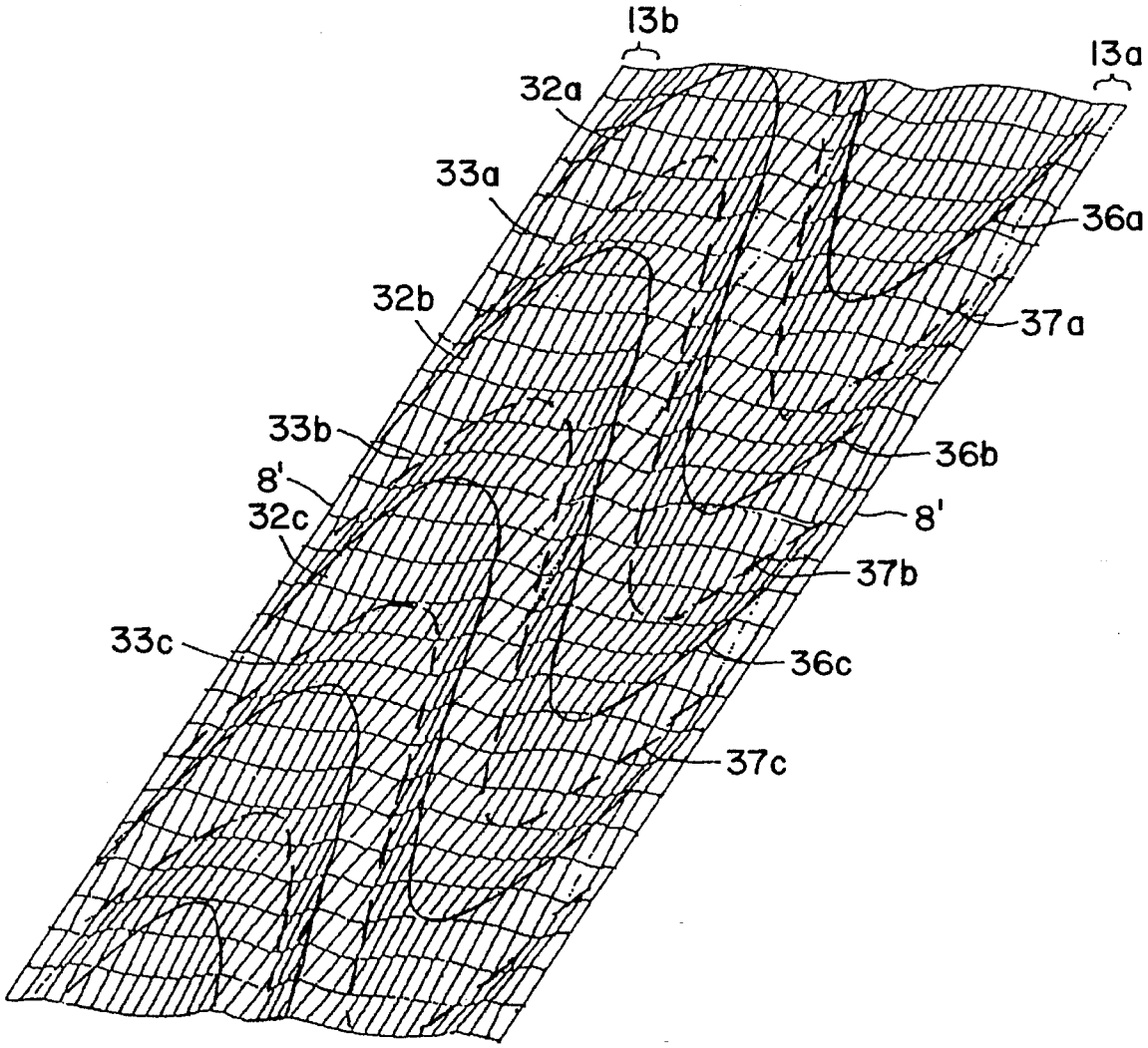
FIG. 6 is perspective view of a strip having two corrugated zones, wherein the corrugation of the two zones continue into each other so that the ridges and the valleys form S-shaped patterns.

This embodiment is suitable for somewhat broader strips than in the embodiments I and II. A strip according to embodiment III is designated 31 in FIG. 6. The strip edges 8' are straight, as in accordance with embodiment II. The ridges 32*a*, 32*b*, 32*c*, etc. and valleys 33*a*, 33*b*, etc. thus are flattening out therein that the amplitude of the embossing pattern .successively is reduced to zero. Ridges 32*a*, 32*b*, 32*c*, etc., and valleys 33*a*, 33*b*, etc., however, in this case form S-shaped curves when projected on the X-Y-plane, the ridge crest curves 36*a*, 36*b*, etc., and the bottom lines 37*a*, 37*b*, etc. forming two parabola sections. The embossing pattern on one side of the longitudinal centre line of strip 31 may be said to consist of an outer half having an embossing pattern corresponding to that of embodiment II and an inner half having an embossing pattern according to that of embodiment I. On the other side of the centre line of strip 31, the pattern is turned to the other direction, i.e. such that the parabola noses point to the opposite direction in relation to the noses on the other side of the strip, wherein there is obtained the S-shaped wave pattern of ridges and valleys shown in FIG. 6.

Embodiment IV

Figure 7:
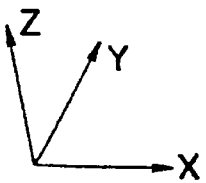
FIG. 7 is a perspective view of a fourth embodiment of a strip of the invention exhibiting two corrugated zones and between these zones a non-corrugated zone.
Figure 7:
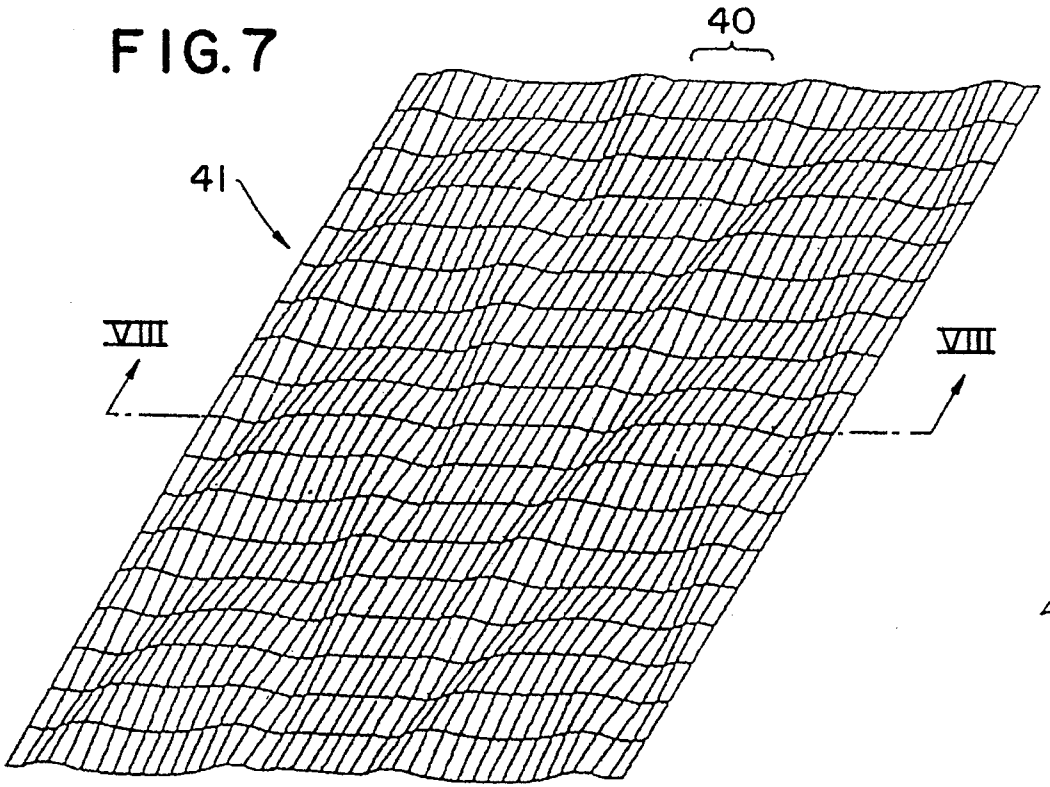
Figure 8:
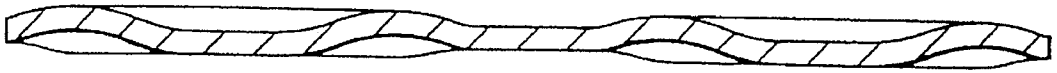
FIG. 8 shows a strip in a cross section along a line VIII—VIII in FIG. 7.

FIG. 7 illustrates a strip 41 according to embodiment IV as seen in a perspective view. The embossing pattern of strip 41 corresponds to two strips 21 of embodiment II, FIG. 5, lying adjacent to each other and between these two conceived strips a flat centre zone 40. Any more detailed description of the embossing pattern should not be required but instead is referred to the description of embodiments I and II in the foregoing and to the cross section IX—IX shown in FIG. 8. Strip 41 can be used for springs, measure tapes etc. When using the strip for a measure tape the flat center zone 40 can be used for a scale.

Embodiment V

Figure 9:
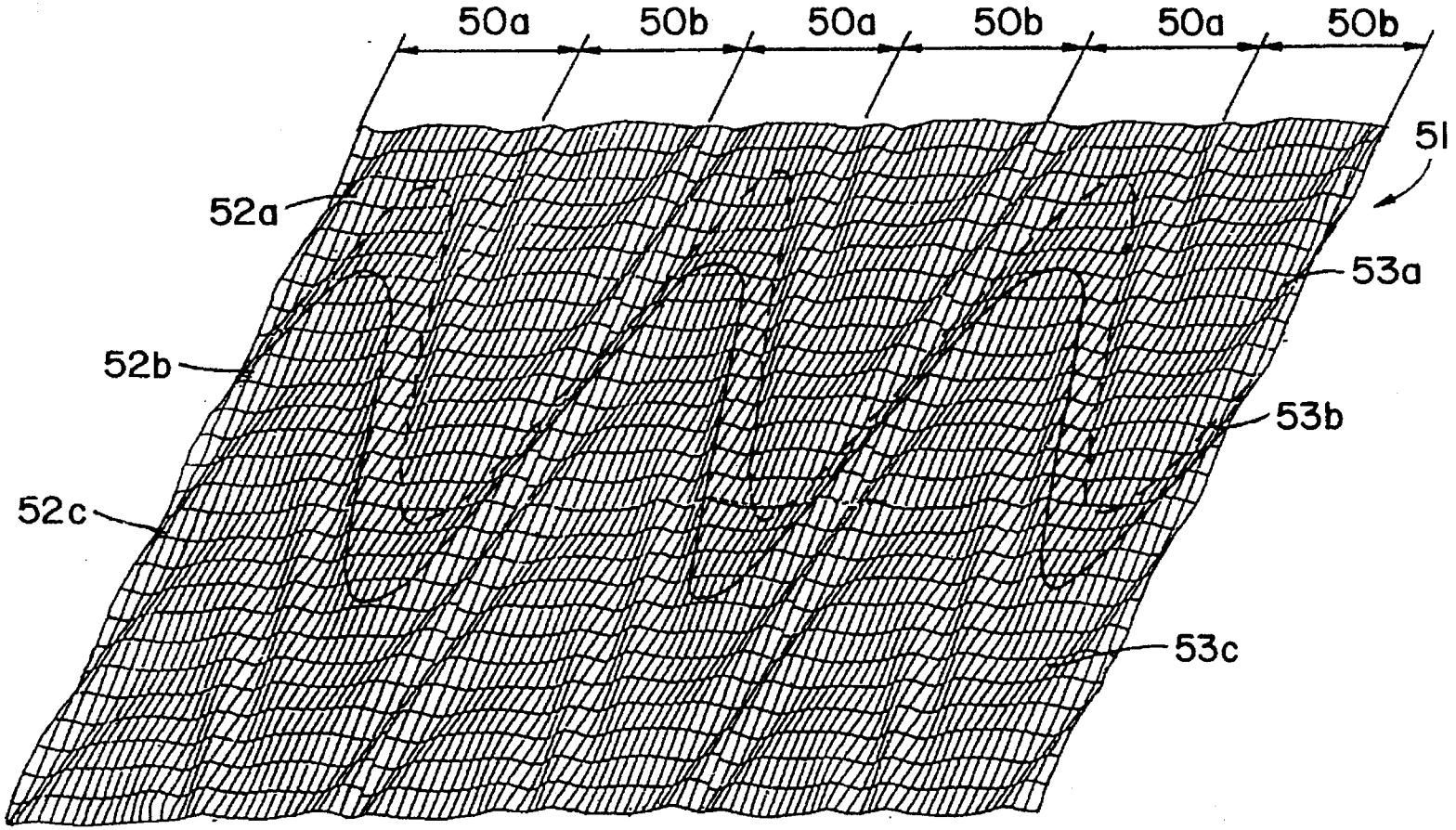
FIG. 9 illustrates a fifth embodiment of the material according to the invention which has the shape of a sheet or a plate having a plurality of zones with continous corrugations.

In FIG. 9 a broader piece of paperboard, sheet or plate according to embodiment V is designated 51. It exhibits a greater number of embossing zones 50*a*, 50*b*, 50*a*, 50*b*, etc., arranged side by side. These zones are identically alike and designed as in embodiment I but every second one is turned the other way round such that the ridges 52*a*, 52*b*, etc. and the valleys 53*a*, 53*b*, etc. continously and meanderlike extend over the whole breadth of sheet 51 from edge to edge 8.

The sheet, foil, plate or corresponding 51 thus embossed can be used as a spring member when it is made of metal, e.g. of hardened steel. It can also be used as a construction material, e.g. if the material consists of a thin sheet of for example steel, copper, or aluminum. It is also conceivable that the sheet consists of paper, board, or plastic or composite materials which contains one or several of the said materials. As distinguished from corrugated board or other corrugated sandwich materials this embodiment may provide a material which is stiff but which can be bent in all directions and which therefore has excellent properties for the use as a packaging material.

Figure 13:
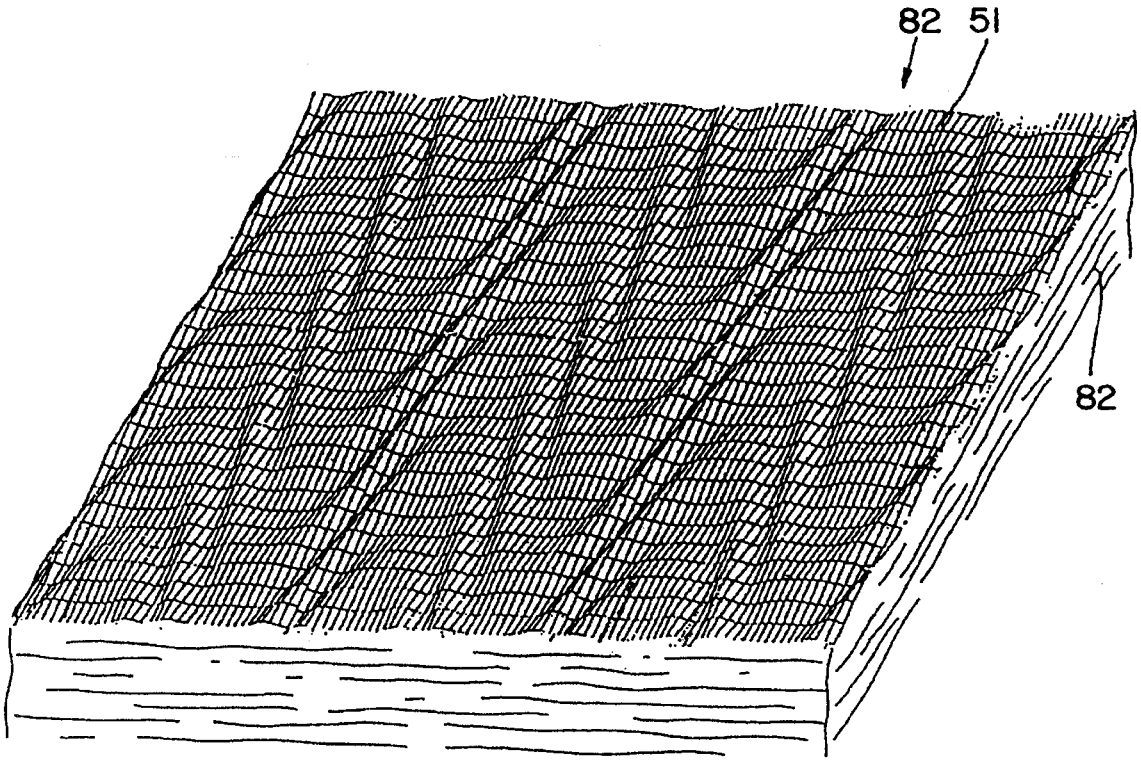
FIG. 13 is a perspective view of a sandwich element consisting of a plurality of sheets stacked on each other, each or every second of said sheets being corrugated according to the invention.

FIG. 13 shows a sandwich element 81 made of a plurality of sheets 51, wherein between each such sheet 51 there is provided a flat sheet 82.

The different layers in the sandwich element 81 are secured to each other e.g. through welding, gluing or by means of any adhesive material.

Embodiment VI

Figure 10:
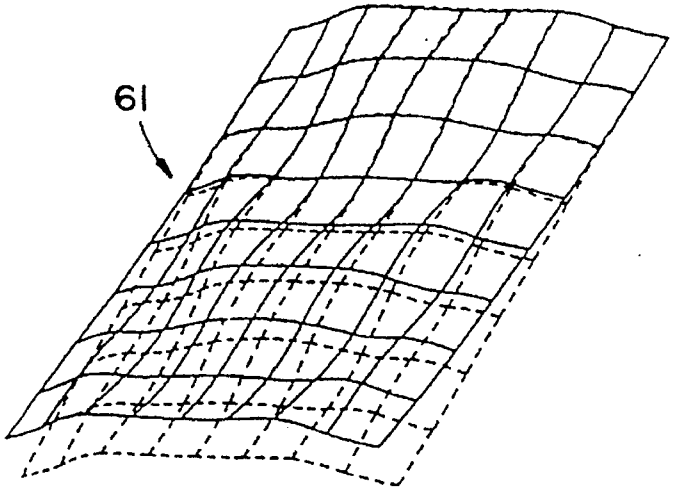
FIG. 10 illustrates in a perspective view how a strip according to a sixth embodiment of the material according to the invention is subjected to bending, in which embodiment the corrugation has been superimposed on a single arcuated basic shape.
Figure 16:
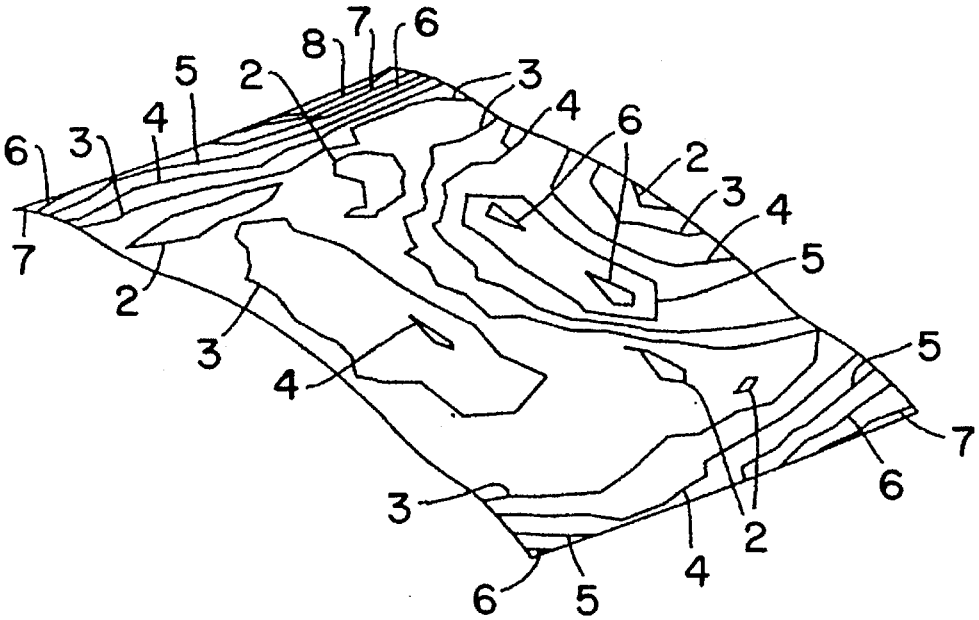
FIG. 16 shows a corresponding tensile chart from testing a strip having the same corrugation pattern as in FIG. 15 but superimposed on a arcuated basic shape.

In order to increase the bending resistance of the material, the parabolas or the circular arcs also may be afforded a curvature in the X-Z-plane by affording the material an arcuated shape in the said plane. FIG. 10 (and also FIG. 16) illustrates in a perspective view a portion of an arcuated strip 61. The embossing pattern is superimposed on the arcuated shape so that the parabolas or circular arcs are bent also in the X-Y-plane on or in the arcuated shape, which is also shown in FIG. 16.

Embodiment VII

Figure 11:
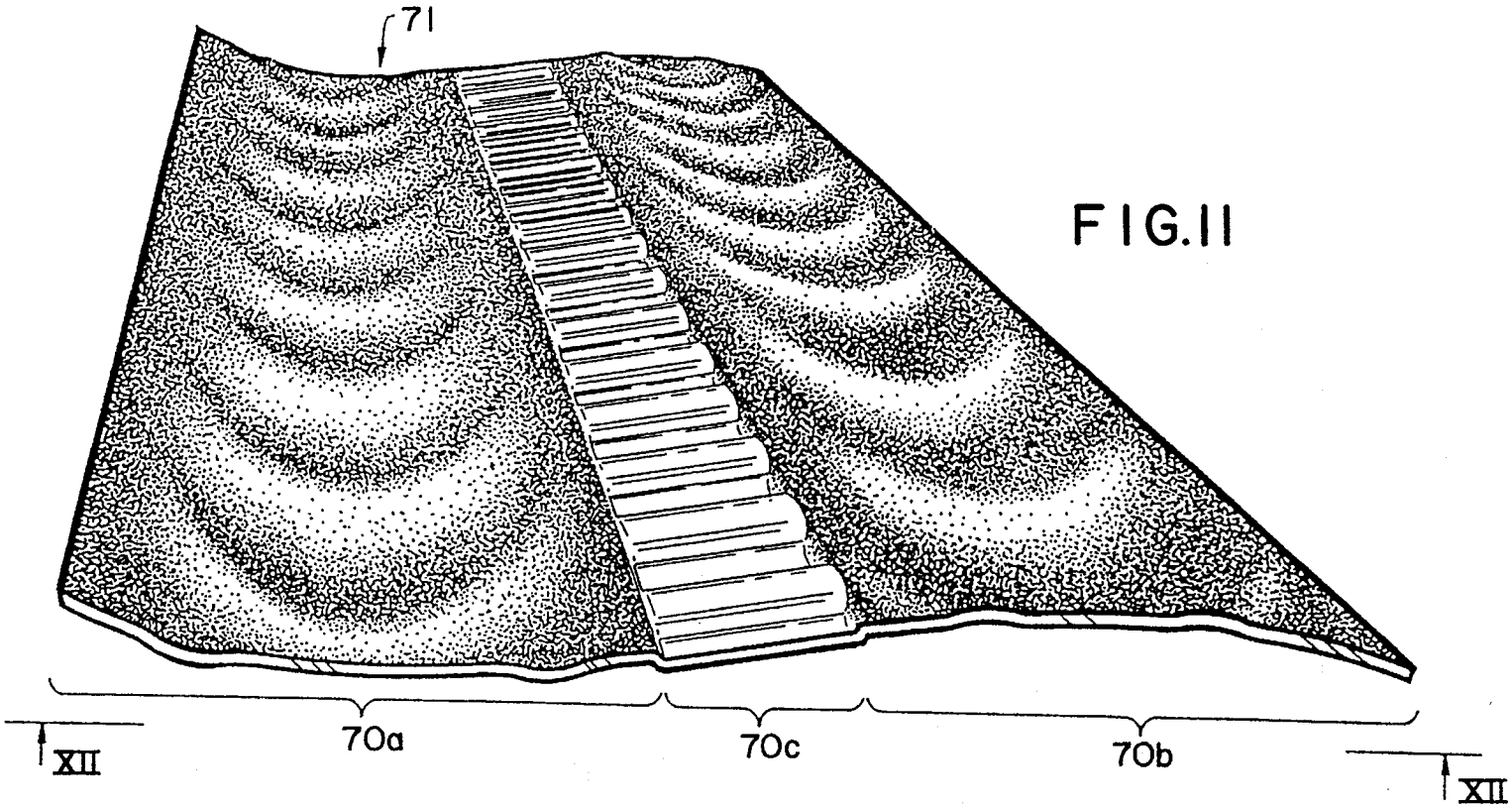
FIG. 11 is a perspective view illustrating a seventh embodiment of the invention in a shape of a strip having two zones with the corrugation pattern of the invention which has been superimposed on a basic shape which is sinusoidal or slightly S-shaped in cross section.
Figure 12:
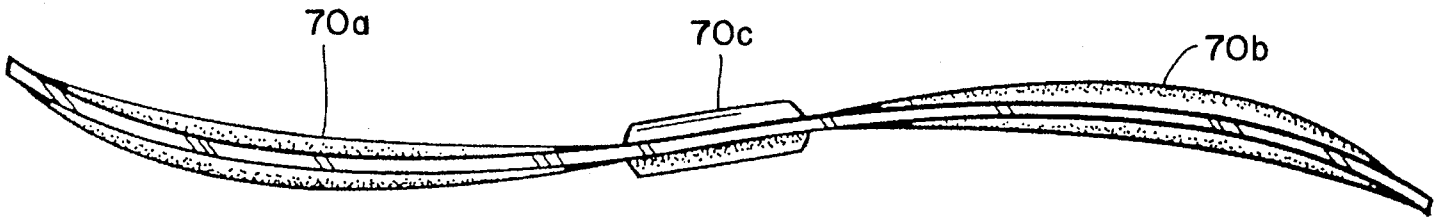
FIG. 12 shows the sinusoidal strip in an end view XII—XII in FIG. 11.

This embodiment is illustrated in FIGS. 11 and 12. It has the shape of a strip 71 exhibiting two zones 70*a* and 70*b*, each of which is provided with an embossing pattern according to embodiment II, which is applied on a sinusoidal (S-shaped in cross-section) basic shape of the strip, which is illustrated in FIG. 12. Each zone 70*a* and 70*b*, respectively, can be regarded as arcuated as strip 61, but the arcs are turned in opposition directions, so that the strip receives a convex-concave or slight S-shape in cross section, in FIG. 12. Due to this convex-concave or S-shaped cross section, the strip 71 is afforded the same bending resistance in the negative and in the positive Z-direction.

The strip 71 is designed in the first place for measure tapes. A centre zone 70*c* therefore is provided with a tooth formed embossing pattern suitable for magneto resistive detection, although also other detection or sensing methods can be used with this pattern, i.e. mechanical, optical or purely electrical.

Due to the embossing pattern of the invention which has been superimposed on the S-shaped basic shape of the strip, a measure tape made of the strip 71 has a stiffness which is several times larger than a conventional steel measure tape having the same material features, including the same thickness. It is also a characteristic feature of the strip of the invention, and this particularly concerns the above described embodiments, that it is not particularly disposed to buckling or collapsing when subjected to overloading as is typical for conventional steel measure tapes, but is as far as these features are concerned more like a conventional folding rule and is stiff in a symmetrical mode because of the sinusoidal (S-shaped) basic shape, at the same time as the strip can be reeled up in a strip housing.

The practical importance of these features is that the strip 71 is not flabby as conventional measure tapes but instead can be handled in a mode similar to that of a folding rule because of its stiffness. The sinusoidal basic shape (the S-shape, FIG. 12) also allows the strip to rest stable against a support so that lines can be drawn and markings be made along the scale using the strip 71 as a ruler, and wherein the millimetre markings on the edge zones 70*d* can be read close to the object in contrast to the conventionally arcuated (C-shaped) measure tapes which have a pronounced tendency to rock. Thanks to the symmetrical stiffness of the sinusoidal and micro-corrugated strip 71 it is also possible to hold the strip vertically upwards, e.g. in connection with measuring against a ceiling or the like, without the strip falling down even if the height to the ceiling is considerable, which is a problem when using conventional steel measure tapes.

A strip having the embossing pattern of the invention superimposed on an arcuated or sinusoidal basic shape, as in accordance with strip 71, is also very advantagous to use as an antenna for portable radio or TV receivers. In this case of course no scale is necessary as has been described above. The material advantageously also can be used for springs which desirably shall have the same stiffness in both directions.

Experiments

Steel strips having a breadth of 6.5 mm and a thickness T=0.12 mm were used as test samples. In one case there was used a strip 21 according to embodiment II, FIG. 5, i.e. a strip having a flat basic shape and in three other tests there was used a arcuated strip according to embodiment VI, FIG. 10. The wave length L of the corrugation, FIG. 2, the embossing depths or amplitude A, FIG. 2, and the phase difference F, see above under heading embodiment I, were varied. The arcuated strips (C-shape) had an arcuation radius of 10 mm.

For the four tested strips, the following parameters applied:

The four strips were subjected to varying bending moments resulting in more or less pronounced bending. The ratio between bending (inverted value) and the bending moment is seen in the chart in FIG. 14. In this chart, there is also included a corresponding chart for a completely flat, non-embossed strip having the same breadth, thickness and quality as the strips listed in the table.

The highest bending moment was measured for strips 61A and 61B which are subjected to bending against the concave side of the C-shape, but if the graphs are extrapolated, strip 61C, which strip is subjected to bending against the convex side of the strip, will intersect the other graphs. A linear ratio and as high bending moment as possible are desired. The basic shape for the tested strips and the load direction have also been indicated by symbols in the chart. Strip 61B and 61A were bent towards the convex side of the strip, while strip 61C was bent towards the concave direction. This indicates that there is a certain asymmetry depending on convex or concave bending direction. This asymmetry, however, is strikingly small.

A number of conclusions can be drawn from the chart. Thus there is obtained a higher stiffness, i.e. a larger bending moment, if the embossing depth is increased; strip 61A as compared with 61B. Strip 61C has a linear characteristic within a large region of the graph which implies that the strip can be bent to a smaller radius without permanent deformation. In this respect, however, strip 21 has the best characteristic, i.e. is almost linear. On the other, the bending resistance is substantially smaller than for strips 61A–61C.

Most striking, however, is that the combination of the arcuated (convex/concave) basic shape and the embossing pattern superimposed on this basic, shape affords an extraordinarily high increase of the material stiffness to the strip. If for example the completely flat, non-corrugated strip has a stiffness (bending moment) having an index 1, the embossed strip 21 of the invention having a flat basic shape will get a stiffness index 4, while the arcuated and embossed strips 61A–61C obtain a stiffness index in the order of 12. This shows that a clear synergism is obtained by combining the corrugation and the arcuation of the corrugated strip zone.

Figure 2:
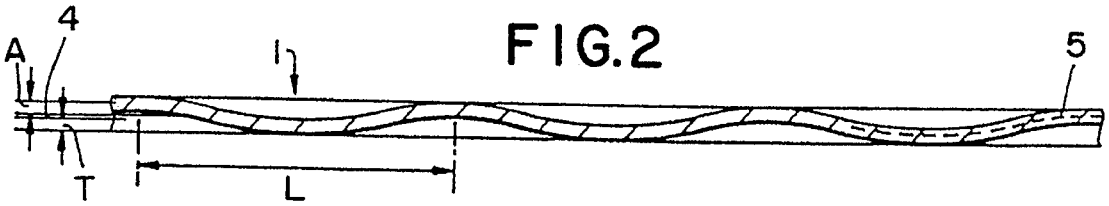
FIG. 2 is a longitudinal section through the strip in a symmetry plane along the line II—II, in FIG. 1.
Figure 3:
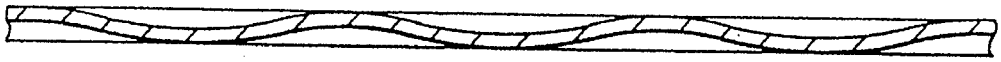
FIG. 3 is a longitudinal section through the strip along a line III—III in FIG. 1.
Figure 4:
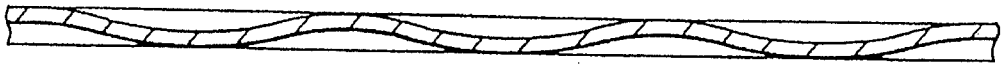
FIG. 4 is a side view of the strip along the line IV—IV in FIG. 1.

In the described embodiments the embossing has been made symmetrically about the zero-plane 4, FIG. 2. It is, however, possible to make the embossing asymmetric relative to the zero-plane 4, wherein it is possible to obtain the effect that the strip will get a greater resistance against bending in one Z-direction than in the opposite one, which may be a worthwhile feature if the strip shall be used e.g. as a spring. It is also possible to make use of this asymmetry in order to compensate for the slight asymmetry caused by the C-shape, as shown by the difference between 61B and 61C, in order to provide a symmetric stiffness of the strip or the sheet without using a sinusoidal or S-shape.

Figure 14:
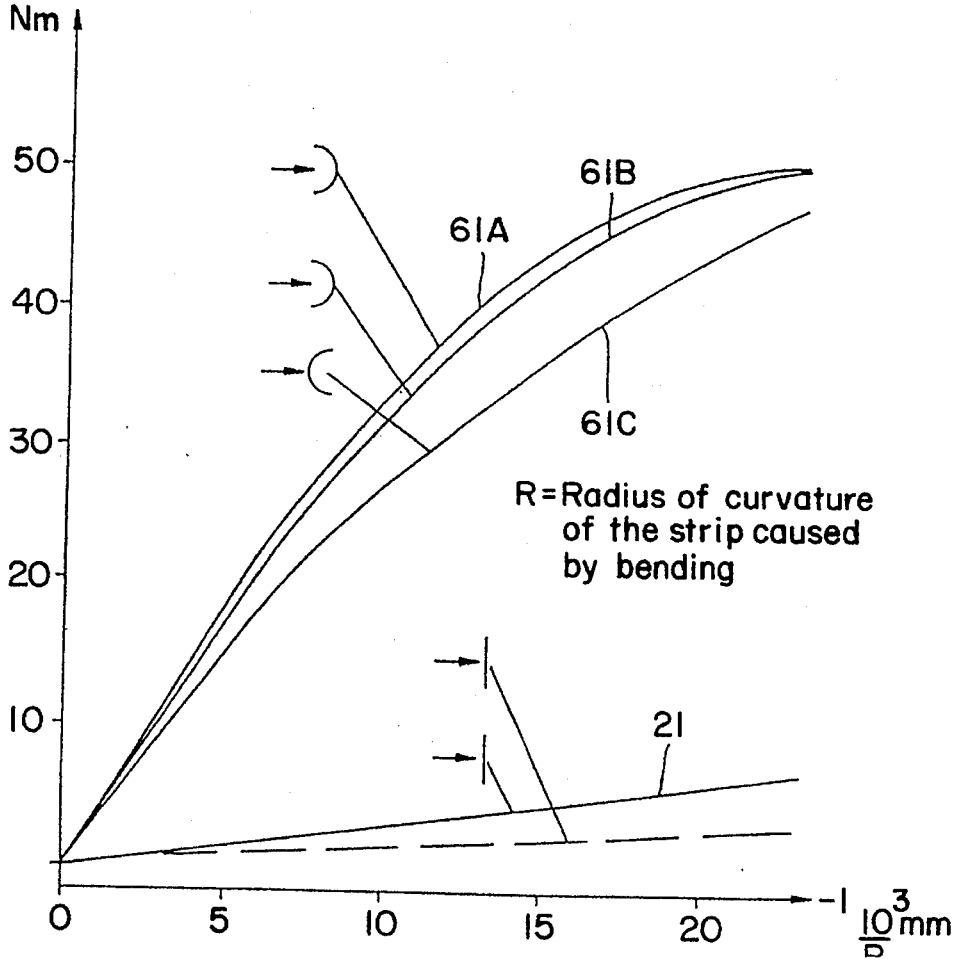
FIG. 14 is a chart illustrating the bending moment versus the inverted value of the radius of curvature of the strip caused by bending the tests of strips designed according to various embodiments of the invention.

The graphs for strips 61A–61C shown in FIG. 14 successively flatten out, which is not shown in the chart, such that the graphs asymptotically approach a given, almost constant

TABLE 1

| Strip | Breadth mm | Thickness T mm | Wave length L mm | Amplitude A (embossing depths) mm | Phase difference F rad | Radius of arcuation mm |
|---|---|---|---|---|---|---|
| 21 | 6.5 | 0.12 | 4.5 | 0.094 | $2\pi$ | flat |
| 61A | 6.5 | 0.12 | 6.0 | 0.11 | $13/6\pi$ | 10 |
| 61B | 6.5 | 0.12 | 4.5 | 0.10 | $13/6\pi$ | 10 |
| 61C | 6.5 | 0.12 | 4.5 | 0.10 | $13/6\pi$ | 10 |

bending moment. This implies that there is obtained a constant bending resistance within a large region independent on the radius of curvature of the strip caused by bending (note inverted value of the radius of curvature in FIG. 14). This is a very interesting feature for flat springs, since this makes it possible to provide springs with very well defined spring parametres, so called constant springs.

The several times increased stiffness combined with a maintained bendability has a considerable economical value, i.a. because of an increased spring power per volume of spring material and also through the versatility of the various embodiments which are useful for various applications.

Figure 15:
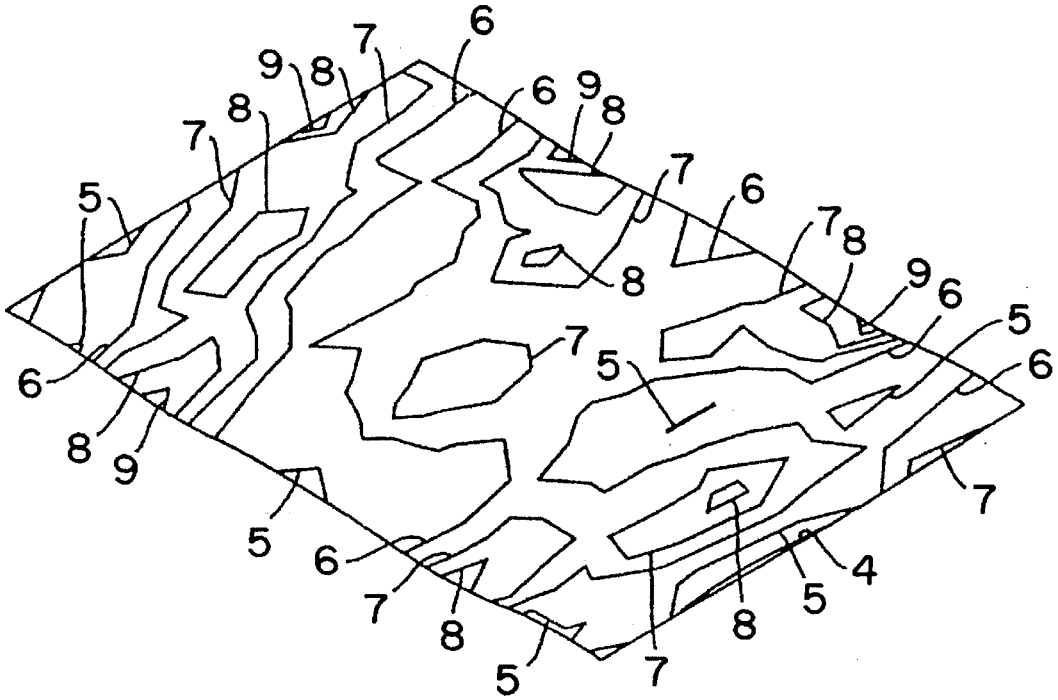
FIG. 15 is a tensile chart from bending tests performed on a strip with the corrugation pattern of the invention but with a flat basic shape and even, straight edges, where the corrugation pattern flat out.

Due to the fact that the invention comprises a number of various parameters which can be varied, such as the embossing depth, phase difference, wave length, the radius of the arcuation (the basic shape), and possible asymmetry of the embossing relative to the zero-plane, there are afforded great opportunities to design materials according to the invention having various desired properties, i.e. springs having specific spring parameters or materials which have an extreme stiffness but which nevertheless can be bent without causing permanent deformation. The latter features are also illustrated by FIG. 15 and FIG. 16 which show the tension distributions in strips according to embodiment II and embodiment VI, respectively, when the strips are subjected to bending moments. In the diagrams in FIG. 15 and FIG. 16, regions having equal tension levels are indicated. These diagrams show that the tensions are distributed in an advantagous mode over the surface of the strip which implies that the strips have a significant buckling resistance.

I claim:

1. A metal strip having increased longitudinal and transverse stiffness, high bendability without permanent deformation, and spring characteristics, comprising:

at least one corrugated zone along a length of the strip and corrugations of the corrugated zones having ridges with valleys therebetween with an isohypsis of said ridges and valleys forming arcs when projected on an X-Y plane of a three dimensional X-, Y-, Z-direction system in which the X-direction coincides with a width of the corrugation zone, the Y-direction coincides with a length of the corrugation zone and the Z-direction is perpendicular to the X-Y plane and longitudinal sections through the corrugated zone form waves in the Y-Z plane, propagating in the Y-direction and alternating in the Z-direction, said waves having a wave lengths and being in a continuously curved configuration; and wherein (a) a depths of the corrugations were $0.5T<A<2T$, where T is a thickness of the strip, A is a corrugation depth defined as the amplitude of the wave pattern from a center line of the strip in a symmetry plane of the corrugation zone coinciding with a tip of the arc of the ridges projected on the X-Y plane; and (b) the height of the arcs was at least as large as the wave length of said waves alternating in the Z-direction.

2. A strip according to claim 1, wherein the arcs are parabolas.

3. A strip according to claim 1, wherein the strip has at least two parallel corrugation zones, each of which exhibits said corrugation pattern.

4. A strip according to claim 3, wherein the arcs point in the same direction in each corrugated zone.

5. A strip according to claim 4, wherein the arcs in one zone point in a different direction than the arcs in a second zone when the number of corrugated zones is two and point alternatingly in different directions when the number of corrugated zones is more than two.

6. A strip according to claim 3, wherein there is a zone between the corrugated zones which is not corrugated or does not have arcs.

7. A strip according to claim 1, wherein the shape of the strip is in the form of an arc within each corrugated zone.

8. A strip according to claim 7, wherein the strip is arcuated in opposite directions within areas of adjacent corrugated zones such that the shape of the strip in the said X-Y plane is essentially S-shape when the strip has two corrugated zones, and is essentially a repeated sinusoidal shape when the strip has more than two corrugated zones.

9. A strip according to claim 1, wherein the strip is cold rolled, hardened and tempered steel having a thickness (T) of 0.01–1.0 mm.

10. A strip according to claim 1, wherein the strip has two corrugation zones and between these two zones has a zone with a corrugation pattern suitable for magneto-resistive reading.

11. A strip according to claim 1, wherein crests of the ridges and bottoms of the valleys are asymmetrically displaced in relation to a mean level of the strip.

12. The strip according to claim 1, wherein the strip has edges outside of the corrugation zone.

13. The strip according to claim 1, wherein the strip has a curved shape in the Z-direction, the corrugation being superimposed on said curved shape.

* * * * *